United States Patent [19]

Ponce

[11] Patent Number: 4,685,252

[45] Date of Patent: Aug. 11, 1987

[54] RECIPROCATING SANDER

[76] Inventor: Felix C. Ponce, 225 S. Manhattan Pl., #104, Los Angeles, Calif. 90004

[21] Appl. No.: 757,452

[22] Filed: Jul. 22, 1985

[51] Int. Cl.[4] ..... B24B 23/04

[52] U.S. Cl. ..... 51/170 TL; 51/180

[58] Field of Search ..... 51/180, 170 TL, 170 R, 51/170 T, 170 EB, 170 MT; 403/57

[56] References Cited

U.S. PATENT DOCUMENTS

| | | | |
|---|---|---|---|
| 1,138,926 | 5/1915 | Bernett | 51/170 PT |
| 1,391,221 | 9/1921 | Tuttle | 51/170 T |
| 2,753,669 | 7/1956 | Larson | 51/180 |
| 4,062,152 | 12/1977 | Mehrer | 51/170 R |
| 4,546,574 | 10/1985 | Blossick | 51/180 |

OTHER PUBLICATIONS

International Application PCT/EP84/00264, Pub. No. WO85/01004 Mar. 1985, Marton.

*Primary Examiner*—Roscoe V. Parker

*Attorney, Agent, or Firm*—Beehler, Pavitt, Siegemund, Jagger, Martella & Dawes

[57] ABSTRACT

A reciprocating sander particularly adapted for sanding remote surfaces such as ceilings and walls is provided by concentrating a substantial part of the weight of the sander in a motor assembly. A lightweight extension tube extends from the motor assembly to a universal joint which in turn is coupled to a sanding attachment. The sanding attachment includes clips which secures a piece of sandpaper in an mechanism for converting angular rotation of the universal joint into relative reciprocating motion of a sanding plate and sandpaper with respect to the sanding attachment. By bringing relative force between the sanding attachment and the motor assembly, a resiliently retained driving rod within the extension tube, which is coupled to the universal joint and sanding attachment, is forced downwardly in the extension tube toward the motor assembly. This ultimately causes two clutch parts to engage thereby permitting the transmission of the motive force to the sanding attachment. The reciprocating sanding plate carrying the sandpaper has a distance of reciprocation just equal to the overhang of the basal plate of the sanding attachment so that no dead zone is established around the periphery of the sanding attachment which is not effectively reached by reciprocating sandpaper. The universal joint coupling the sanding attachment to the extension tube is provided with contoured mated bearing surfaces so that the universal joint smoothly operates even when the joint is configured into extreme angular configurations which brings opposing parts of the joint in contact with each other.

11 Claims, 12 Drawing Figures

Fig. 2.
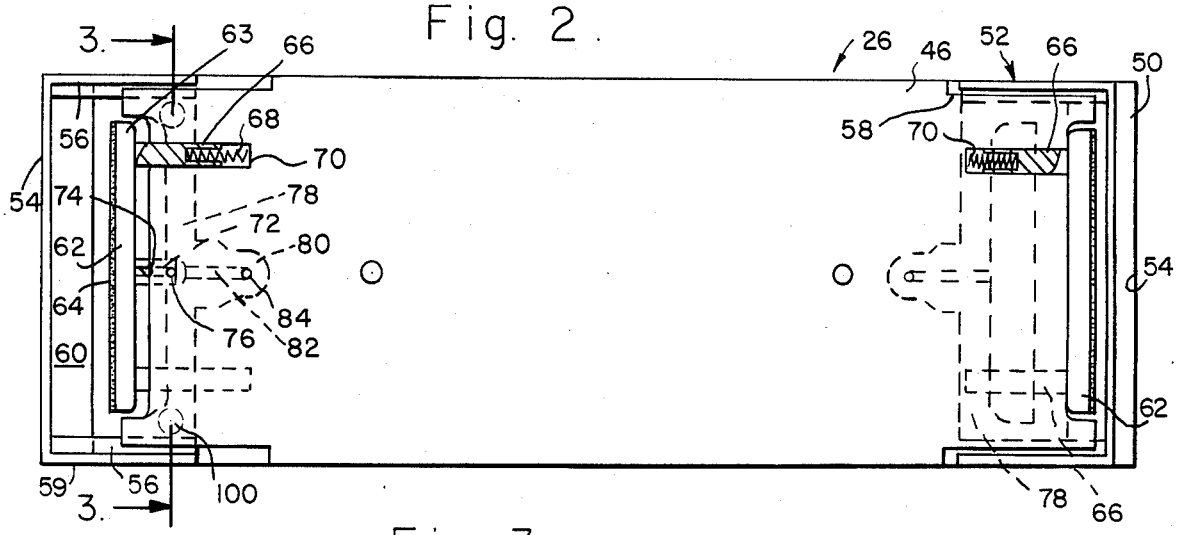
Fig. 3.
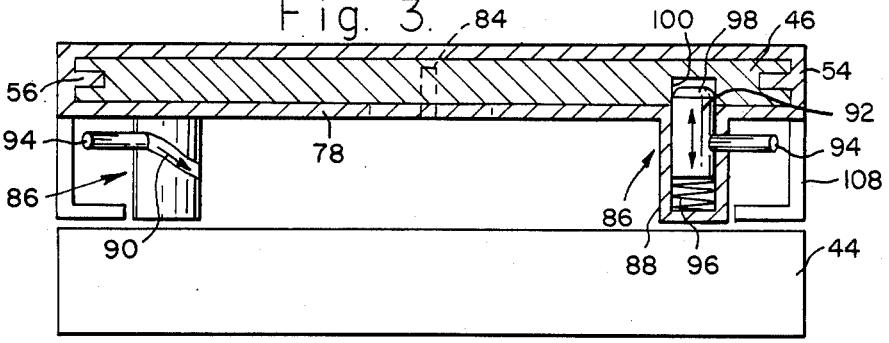
Fig. 6.
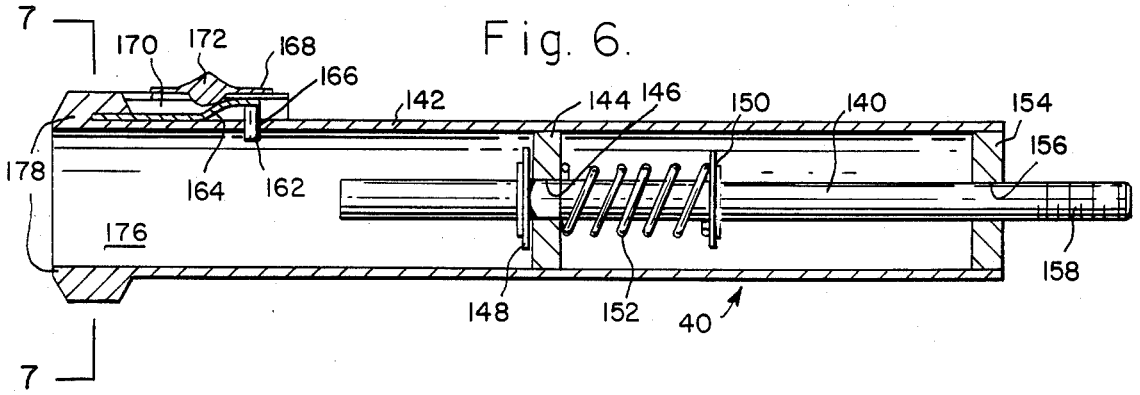
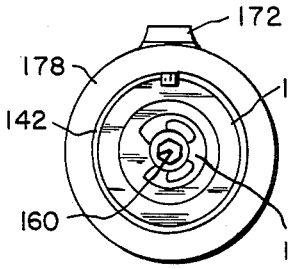
Fig. 7.

RECIPROCATING SANDER

BACKGROUND OF THE INVENTION

1. Field of the Invention

The invention relates to the field of electric hand tools, in particular to a reciprocating sander in combination with an extension arm.

2. Description of the Prior Art

Much of the sanding of cabinet and finish work is done with electric sanders. Presently, electric sanders are of three general designs, namely a linear reciprocating sander, a rotary disc sander, or an orbital sander. Each design has its own advantages with respect to performance, reliability, cost of construction and ease of use. Disc and orbital sanders are characterized, of course, by a rotary motion of the sanding disc. Such sanding discs are necessarily circular in order to accommodate the rotary motion of the sander. However, much of the cabinet and finished work requires the ability to sand in the corners into which the circular disc cannot be placed. For this reason, belt or reciprocating sanders having a generally rectangular sanding surface are particularly useful. However, the performance of belt or reciprocating sanders as known in the prior art, particularly in tight corners, still leaves an area on the margin of the corner which can not be reached by the sander. Clearly, this area includes a width equal to the radius of the rotor on a belt sander and, in the case of a reciprocating sander, may include a distance equal to the overhang of the sander body beyond the limit of vibration of the sanding surface. In addition regardless of the motive apparatus for moving the sandpaper, when the sandpaper is wrapped around the ends of the sanding pad, a small curvature along at least two opposing edges of the sanding surface is unavoidably formed. Such a curvature serves to limit the effective distance to an adjacent edge or wall within which such a sander can operate. For the purposes of this specification areas in such corners which cannot be reached due to sander configuration or design shall be defined as "dead zones."

Furthermore, even in the case where the dead zone is relatively small, the design of such reciprocating sanders requires the motive source for reciprocation to be mounted immediately behind the sanding pad. Normally, such a vibrating motor operates at relatively high frequencies and with small excursions. The vibrating motion is imparted by such motors to the sanding pad in such a way that close and intimate contact is needed between the vibrator and the sanding pad. Therefore, when such sanders must be used to sand relatively inaccessible surfaces, such as ceilings and corners of ceilings and walls, the great bulk of the tool's weight must be carried by the user above his head and often at extended distances from the body. This type of usage quickly results in fatigue and pose a serious practical limitation on the degree to which such tools can be effectively be used to sand ceilings, upper walls and other relatively inaccessible surfaces.

What is needed then is a sander which is characterized by having virtually no dead zone and which is of such a design as to permit usage on relatively inaccessible surfaces such as ceilings or upper walls in such a manner that prolonged use by the user does not cause fatigue or requires strength and strenuous effort to hold the tool in place or to manipulate it for extended times.

BRIEF SUMMARY OF THE INVENTION

The invention is a sanding tool comprising a lightweight sanding attachment; a lightweight extension drive tube coupled to the sanding attachment; and a motor coupled to the extension drive tube. The motor is characterized by comprising a substantial portion of the weight of the tool and for providing the motive force to the sanding attachment through the extension drive tube. As a result of this combination of elements a sanding tool is provided for use at positions spaced from the motor by at least a distance equal to the length of the extension drive tube and a substantial portion of the weight of the sanding tool is concentrated in the motor assembly.

The tool further comprises a universal joint, which couples the extension drive tube and the sanding attachment to each other in a operative driving relationship. The universal joint is further comprised of a first and second member. The first member is coupled to the extension drive tube and the second member is coupled to the sanding attachment. The first and second member are each rotatably coupled to each other. The first and second member is further characterized by a plurality of mating surfaces wherein in extreme angular orientations of the first member with respect to the second member, the first and second member come into contact and the surfaces of the first and second member form smooth bearing surfaces with respect to each other. In extreme angular orientations of the first member relative to second member, the angular orientation is restricted without interfering with the smooth relative rotation of the first member relative to the second member.

The sanding attachment comprises a sanding plate and a basal plate. The sanding plate is reciprocatingly driven with respect to the basal plate. The sanding plate is characterized by an effective sanding surface. The effective sanding surface of the sanding plate is reciprocatingly disposed during reciprocation to be congruent at least at one point in time with the projection of the basal plate upon the sanding plate. By reason of this combination dead areas are substantially eliminated.

The extension drive tube comprises a resiliently biased rotatable drive rod disposed therethrough and a resiliently biased clutch coupled between the rod and the motor assembly. The resiliently biased clutch is resiliently biased in a disengaged configuration. The drive rod is urged against the resilient bias to cause the clutch to assume an engaged configuration. The drive rod is urged against the resilient bias by pressure being manually applied between the sanding attachment on the one hand and the extension drive tube and motor assembly on the other.

When expressed from yet another viewpoint, the invention is a reciprocating sanding tool comprising the following elements. A motor assembly for providing a motive force is coupled to an extension drive tube rigidly. An extension drive rod is resiliently disposed within the drive tube with the drive rod being resiliently urged to assume a preferred longitudinal position while being freely rotatable within the drive tube. A clutch assembly is coupled between the motor assembly and extension drive rod with the clutch assembly resiliently urged into a disengaged configuration. A universal joint is coupled to the drive rod with the universal joint being characterized by exterior smooth mating bearing surfaces to permit free sliding contact between the opposing surfaces of the universal joint during operation even when the universal joint is configured into extreme angular configurations. A basal plate is coupled to the universal joint. A sanding plate is coupled to the basal plate. Coupling of the sanding plate and basal plate permit relative reciprocating motion between the sanding plate and basal plate with reciprocation of the sanding plate disposing the sanding plate in space to the same extent as the basal plate extends in space. Finally a mechanism for converting rotary motion of the universal joint into relative reciprocating motion between the basal plate and sanding plate is provided.

The extension drive tube, extension drive rod, universal joint, basal plate, sanding plate and mechanism for converting are each lightweight elements, so that the substantial portion of weight of the tool is confined to the motor assembly.

The extension drive rod is resiliently disposed within the extension drive tube and coupled to the clutch assembly so that the relative force between the sanding plate and the motor assembly coupled through the extension drive tube, universal joint and basal plate causes the clutch assembly to assume an engaged configuration.

The invention also includes a method of delivering motive power to a sanding attachment comprising the steps of driving a clutch assembly and forcing the clutch assembly towards the sanding attachment against resilient bias which tends to kept the clutch assembly and sanding attachment apart. The method continues with the step of engaging the clutch assembly to transfer motive force through the clutch assembly to the sanding attachment after the clutch assembly has been displaced against resilient bias toward the sanding attachment by a predetermined distance.

The invention also includes the step of rotating a universal joint coupled between the sanding attachment and driving rod within the extension tube. The step of rotating the universal joint then causes adjacent surfaces of the universal joint to be brought into contact. These surfaces are brought into sliding contact and the surfaces act as bearing members against each other while rotating the universal joint between extreme angular orientations. By reason of this combination of steps smooth operation of the universal joint is insured even at extreme angular orientations of the universal joint.

The method further comprises a step of reciprocating a sanding plate with respect to a basal plate in response to the step of engaging the clutch. The sanding plate is reciprocated to a predetermined extent in space. The spatial extension of the reciprocating sanding plate is equal to the spatial extent of the basal plate in a plane parallel to the basal plate.

The invention can also be characterized as a universal joint comprising a first joint member; a second joint member; and an X-shaped pin rotatably coupled to the first and second members. Rotation of the first and second members relative to each other and the X-shaped pin are independent. The first member is rotably coupled to opposing ends of leg of the X-shaped pin and the second member is rotatively coupled to opposing ends of the other leg of the X-shaped pin. The first and second members are relatively orientable at extreme angular configurations to bring surface portions of one the member into sliding contact with surface portions of the other the member. The surface portions of the first and second member are complementarily contoured so that at every extreme angular position between the first and second members at least one point of mutual contact between the first and second members exists, and the opposing surfaces form a smooth bearing surface. By reason of this combination of elements smooth operation of the universal joint is permitted at high speeds and at all angular relative extremes of configuration of the first and second members.

BRIEF DESCRIPTION OF THE DRAWINGS

FIG. 2 is a bottom plan view of the sanding attachment with selected portions shown in cross-sectional view;

FIG. 3 is a cross-sectional view in enlarged scale take through line 3—3;

FIG. 6 is a cross-sectional view in enlarged scale of an upper tube extension segment which is coupled to the universal joint of the invention at one of its ends;

FIG. 7 is an elevational view of the tube attachment shown in FIG. 6 as seen through lines 7—7;

The invention and its various embodiments may be better understood by now turning to following detailed description.

DETAILED DESCRIPTION OF THE PREFERRED EMBODIMENT

Figure 1:
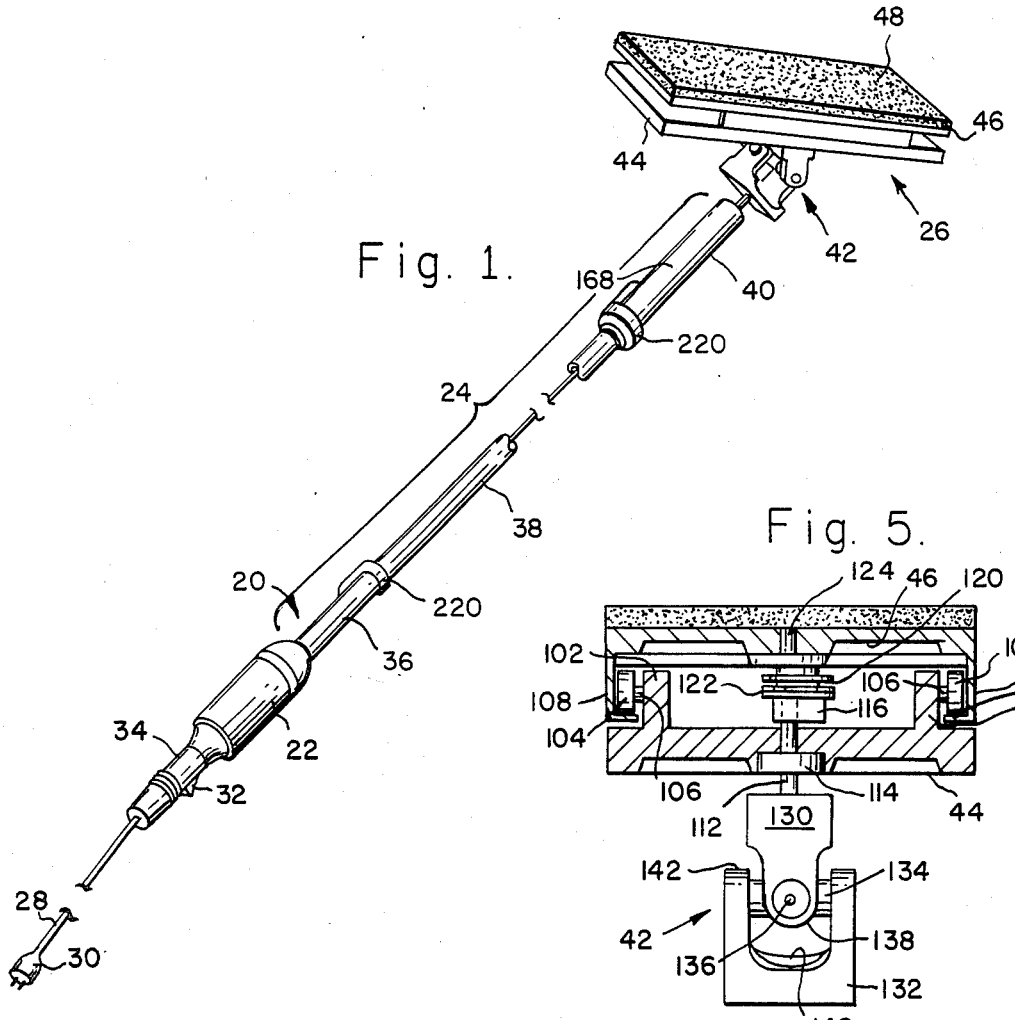
FIG. 1 is a perspective view of the assembled sander shown in combination with a full extension tube.

The present invention is a reciprocating sander in which the sanding attachment, which carries the sanding pad, is of such a design that it is extremely light and is characterized by virtually no dead zone, that is, no surface area to which the sanding pad can not be effectively applied even when used against walls or corners. The reciprocating sanding pad which holds the sandpaper is held on a base having a slightly smaller planar dimension and extent than the sanding pad. Therefore, even if the configuration with the sanding pad is at its minimum retraction with respect to the base, the sanding pad and sandpaper still extend slightly beyond the periphery of the base, thereby allowing the sandpaper and sanding pad to be placed immediately adjacent to or into a tight corner without interference from the base at any point during the stroke of the reciprocating pad. The sanding attachment is driven by a remotely positioned motor such that the bulk of the weight of the tool remains in the hands of the user and not in the sanding attachment. The sanding attachment is positioned remotely from the user by means of a extension drive tube. The invention can be better understood by now turning to the perspective view of the assembled tool as shown in FIG. 1.

The tool, generally denoted by reference numeral 20, is comprised of a conventional rotary electric motor 22, a composite extension tube, generally denoted by reference numeral 24, and a sanding attachment, generally denoted by reference numeral 26. Motor 22, which in the illustrated embodiment is an A/C powered rotary motor which comprises the bulk of the weight of the tool 20, is hand-held by the user. Motor 22 receives its power by means of a conventional A/C cord 28 terminated with a conventional plug 30. Motor 22 in turn is controlled or turned on and off by means of a switch 32 included within a hand grip 34 extending from the base of motor 22.

Motor 22 is then coupled to extension tube 24, which in the illustrated embodiment is comprised of three sections, a motor section 36, mid-section 38 and an attachment section 40. Each of these sections will be described in greater detailed in connection with FIGS. 6–12. Attachment section 40 is coupled to a universal joint, generally denoted by reference numeral 42. Extension tube 24 has a shaft running throughout its length which is rotationally fixed with respect to the output shaft of motor 22. Thus, a rotary torque is delivered to universal joint 42 and hence coupled to sanding attachment 26. The rotary motion of universal joint 42 is then converted into a reciprocating motion as described in greater detailed in connection with FIGS. 4 and 5.

Sanding attachment 26 is comprised of a stationary base 44 and a reciprocating sanding pad 46. In the illustrated embodiment a resilient foam or rubber pad 48 is then disposed upon sanding pad 46 and a conforming length of sandpaper is then attached to sanding attachment 26 across the pad 48 in a manner which can be described in detail by reference to FIGS. 2 and 3.

Turn now to plan view of sanding attachment 26 as shown in enlarged scale in FIG. 2. In the view of FIG. 2, foam pad 48 has been removed to more clearly expose the top surface of sanding pad 46 in order to illustrate the mechanism used to attach the sandpaper thereto. The sandpaper, not shown, has a width equal to the width of sanding disc 46 and a length sufficiently longer than the overall length of sanding pad 46 to allow the ends of the sandpaper to be folded over end 50 of a retaining clip, generally denoted by reference numeral 52. The sanding pad 46 is provided with retaining clips 52 at both its left and right ends as shown in FIG. 2. The right hand side clip 52 in FIG. 2 is shown in closed configuration while the left hand clip 52 in FIG. 2 is shown in an open configuration.

Consider the left hand opened clip 52. Clip 52 is comprised of a sliding U-shaped retainer 54 which is keyed into plate 46. Retainer 54 includes horizontal keyways 56 as illustrated in FIG. 2 which are disposed into corresponding horizontal slots 58 in plate 46. Retainer 54 further includes a lower shelf 60 which is disposed in the bottom of retainer 54 so as to just clear the bottom edge of a spring loaded clamp 62. Clamp 62 forms a bar 63 across the substantial width of the plate 54 and serves to form a vise-like action in cooperation with retainer 54 against the abrasive sandpaper whose end is folded into retainer 54 over shelf 60 and between retainer 54 and bar 63. Bar 63 is shown as having a resilient, rubberized gripping surface 64 and is coupled to plate 46 by means of telescoping pins 66, one of which is shown in cross-sectional view in the upper left corner of FIG. 2. A pin 66 is provided at each end of bar 63 and is disposed within a corresponding bore 68 defined into plate 46. Bore 68 is a blind hole fitted with a compression spring 70, one of which bears against the end of the blind hole of bore 68 and the other end of which bears against pin 66. Pin 66 is thus slidingly telescoped in bore 68 and spring 70 urges bar 62 outwardly. The outward extension of bar 63 is, however, limited by a retaining bracket 72 attached to the center and back surface of bar 62. Bracket 72 includes a central slot 74 through which a pin 76 is disposed. Pin 76 is fixed relative to plate 46 and thus serves to restrain the outward disposition of bracket 72 and hence the outward movement of this position bar 63.

Similarly, retainer 54 includes a rear cross member 78 extending under plate 46 and shown in dotted outline in FIG. 2. Member 78 similarly includes a bracket 80 with a slot 82 defined therein. A second pin 84 is disposed in slot 82 and fixed to plate 46. Therefore, retainer 54 can be slid outwardly to the left, as shown in FIG. 2, along its keyed slot 58 to the extent permitted by slot 82 and bracket 80 attached to member 78. As shown in dotted outline in FIG. 2, retainer 54 has been outwardly extended to the maximum extent possible in preparation for insertion of a strip of sandpaper between retainer 54 and bar 63.

After the sandpaper is inserted between bar 63 and retainer 54, retainer 54 is manually pressed inwardly, thereby compressing bar 63 against compression springs 70 with the sandpaper tightly gripped between bar 63 and retainer 54. Turn now to FIG. 3 wherein the means for locking retainer 54 in the closed position as shown in the right hand side of FIG. 2 is better illustrated.

FIG. 3 is an enlarged cross-sectional view taken through lines 3—3 of FIG. 2. Rear member 78 of retainer 54 includes a pair of locking pins generally denoted by reference numeral 86. Locking is achieved by pin 92 by disposition of the upper end 98 of pin 92 in a blind hole 100 defined in plate 46. The right hand locking pin as shown in FIG. 3 is shown in cutaway view, while the left hand pin is shown in elevational view. Locking pin 86 includes an outer cylinder 88 in which a curved or spiral slot 90 is defined. A pin 92 is slidingly disposed within housing 88 and has a rigid locking lever 94 affixed thereto and generally perpendicular extending from pin 92. Lever 94 is disposed through slot 90 of housing 88 and serves as a means by which the pin is moved from an upper locked position such as shown in FIG. 3 to a lower unlocked position. Clearly, as lever 94 is manually rotated to the right as shown in FIG. 3, lever 94 is forced downwardly in slot 90 thereby pulling pin 92 within housing 88 with it. Pin 92 is spring loaded by means of compression spring 96 is disposed in the bottom of housing 88. One end of compression 96 bears against the closed end of housing 88 while the opposing end appears against the bottom of pin 92. Therefore, pin 92 is normally urged upwardly into the locked configuration. However, as lever 94 is rotated downwardly, lever 94 reaches an end portion of slot 90. Spring 96 has insufficient compressive force to force pin 92 up within housing 88 without the assistance of manually rotating lever 94. However, once lever 94 is rotated to the left as shown in FIG. 3 and pin 92 positioned in the upward locked configuration, spring 96 serves to retain pin 92 in the upper locked position, notwithstanding the vibrations to which the sander may be subjected during operation.

The means whereby sandpaper 48 is mounted and locked into place upon sanding plate 46 now having been described, consider the mechanism within sanding attachment 26 which provides for the reciprocating motion of sanding plate 46. Turn now to the views of FIGS. 4 and 5.

Figure 4:
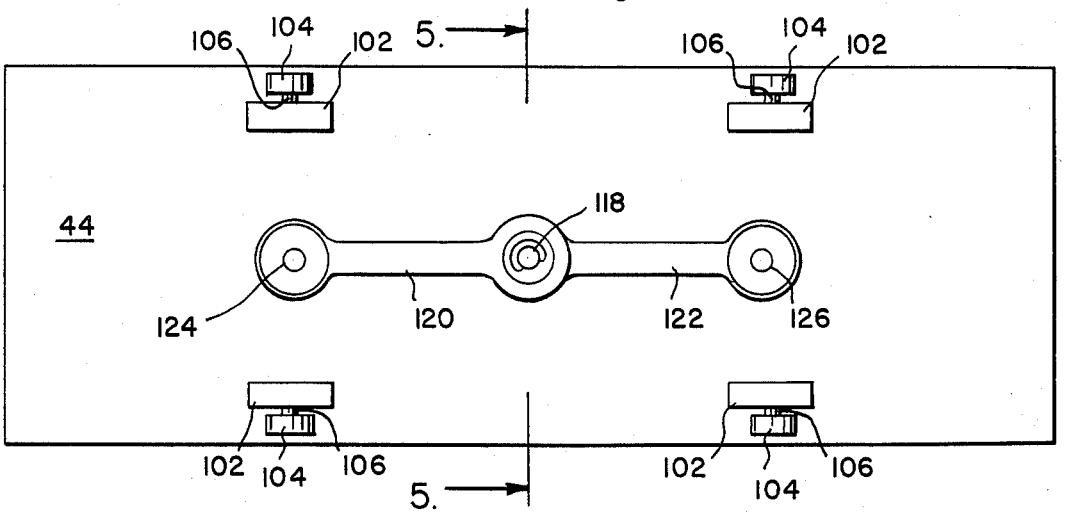
FIG. 4 is a plan view of the lower section of the sanding attachment shown with the upper section removed.

FIG. 4 is an elevational view of base plate 44 shown with sanding plate 46 and its associated elements removed. The base plate 44 includes four vertical tabs 102. Each tab bears on its outer surface, a roller bearing assembly 104. Roller bearing assembly 104 is coupled to rigid tab 102 by means of an axis 106 which positions roller bearing 104 a distance above base plate 44 thereby allowing roller bearing 104 to free wheel.

Figure 5:
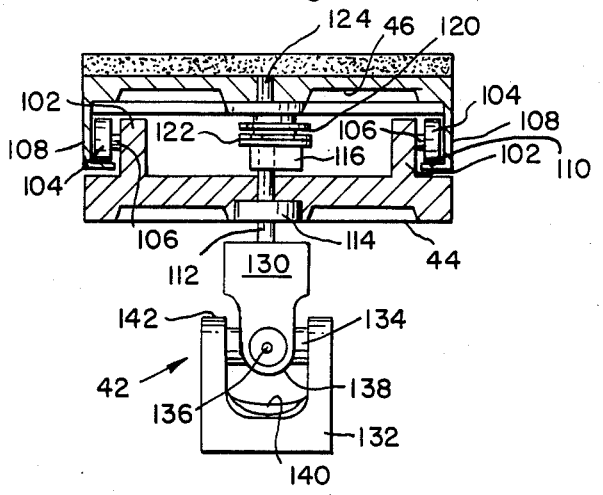
FIG. 5 is a cross-sectional view of the sanding attachment taken through lines 5—5 of FIG. 4 shown with the upper portion of the sanding attachment in place.

Turn now briefly to FIG. 5 which is a cross-sectional elevational view taken through line 5—5 of FIG. 4. Roller bearing 104 thus extends outwardly and slidingly engages a bracket arm 108 extending from sanding plate 46. Roller bearing 104 is thus in rolling contact with an inwardly and horizontally extending portion 110 of bracket arm 108. Arm 108 is better illustrated in enlarged elevational view in the depiction of FIG. 3. Therefore, sanding plate 46 is engaged to base plate 44 by means of arm 108 in combination with the assembly of roller bearing 104. As described in greater detail below, a mechanism reciprocates sanding plate 46 with respect to the base plate 44 thereby causing sanding plate 46 to horizontally reciprocate on the assemblies of bearings 104.

Turning again to FIG. 5, a drive pin 112 is disposed in base plate 44 and carried within a bearing assembly 114. Drive pin 112 is centered within base plate 44 and extends into an eccentric member 116. The eccentric member 116 in turn includes an off-centered pin 118 shown in plan view FIG. 4. Pin 118 is coupled to a left and right crank arm 120 and 122 respectively. The opposing end of each crank arm 120, 122 in turn is pivotally coupled to the sanding plate 46 by means of pin 124 and 126 respectively. Pin 124 is shown in partial cross-sectional view in FIG. 5. Crank arms 120 and 122 are visible in elevational view a and are each separated by appropriate washers, which for the sake of simplicity will remain unnumbered in the illustration of FIG. 5.

Reciprocating motion is imparted to sanding plate 46 by virtue of the rotation of the eccentric member 116. Thus, drive pin 118 which is offset with respect to pin 112 rotates above pin 112 as eccentric member 116 is rotated by pin 112. As drive pin 118 thereby moves in a circle about pin 112, it moves the pivotally attached ends of crank arm 120 and 122 in a corresponding circle. The horizontal component of this circular motion of drive pin 118 is converted by crank arms 120 and 122 through pins 124 and 126 fixed to sanding plate 46 into a horizontally reciprocating sinusoidal motion.

The means for providing a reciprocating motion of sanding plate 46 respect to base plate 44 now having been described, turn to the means by which the motive power is delivered to pin 112 in the first place. Returning your attention to FIG. 5, pin 112 is coupled to a universal joint generally denoted by reference numeral 42. Universal joint 42 includes an upper member 130 and lower member 132. Members 130, 132 are coupled by means of orthogonally crossed and rotatable pins 134 and 136. Just the end portion of pin 136 is seen in FIG. 5 whereas the side portion of pin 134 is fully illustrated. Pin 136 thereby rotates about its longitudinal axis which is perpendicular to the longitudinal axis of pin 134. Pin 134 similarly rotates about its longitudinal axis which is perpendicular to the longitudinal axis of pin 136. Members 130, 132 are thus each provided with two degrees relative rotation freedom. Rotation is facilitated by mounting bearings at the end of each pin 134 and 136 within members 130, 132 as it is well known to the art.

Universal joint 42 is particularly characterized by being sculptured in order to provide smooth and free operation when angled such as shown in the configuration of FIG. 1. For example, when universal joint 42 has been angled about pin 134 to the maximum degree, rotation is still freely permitted about the orthogonal pin 136. As members 130, 132 rotate relative to each other while one of the pins, such as pin 134, is fixed in its maximum angular inclination, the rounded surface 138 of member 130, for example, smoothly bears against a mating surface 140 in the opposing member 132. Similarly a surface in member 130 analogous to surface 140 will at one point in the rotation bear against the rounded surface 142 of member 132 which is analogous to surface 138 of member 130. Other portions of members 130 and 132 may contact each other during the relative rotation of the members when the two members are positioned respective to each other at an angular extreme. Therefore, the opposing surfaces of members 130 and 132 are sculptured so as to smoothly mate during the extreme angular configuration of universal joint 42 whereby jamming or jerky operation of universal joint 42 is avoided. Any type of sharp angularity or irregularity would otherwise cause unacceptable jamming or excessive vibrations at the rpm rates at which universal joint 42 is driven.

Stated alternatively, pins 136 and 134 in and of themselves have no means for limiting the relative motion of members 130, 132. The relative angular orientation of members 130, 132 are simply limited by their mutual contact at the angular extremes of the universal joint. Since it is contemplated that during operation members 130 and 132 will be brought into contact with each other at relatively high rates, the surfaces of elements 130 and 132 which are thus brought in contact are sculptured and mated so as to form smooth mutual bearing surfaces with respect to each other. As specifically described, surface 138, for example, of member 130 will bear against surface 140 of member 132. These surfaces are thus three-dimensionally formed as mutual bearing surfaces allowing for the smooth contact and relative angular rotation of members 130, 132.

As shown in FIG. 1, rotational energy is delivered to drive pin 112 through universal joint 42. Rotational energy is imparted to member 132 of universal joint 42 by means of an extension rod 24. Turn now to FIG. 6 wherein an upper portion 40 of extension rod 24 is illustrated in cross-sectional view in enlarged scale. Element 132 is threaded into a spring-loaded drive rod 140. Drive rod 140 is telescopically held within tubular extension 142. An internal first support member 144 is disposed within extension 142 and is provided with a central bore 146 through which rod 140 extends and rotates. Rod 140 is captively retained and resiliently biased with respect to support number 144 by means of compression lock washers 148, 150 and compression spring 152. Lock washer 148 is disposed on the left side of support member 144 as shown in FIG. 6 while lock washer 150 is disposed at a predetermined distance on the opposing side of the support member 144 on rod 140. Compression spring 152 is concentrically disposed about rod 140 between second lock washer 150 and support member 144. A second rigid support member 154 is provided at the end of tube 40 and includes a bore hole 156 through which rod 140 is rotatably disposed. Therefore, rod 140 is free to rotate within support members 144 and 154 and is further free to be longitudinally displaced therein subject to the resilient urging of compression spring 152 which urges rod 142 to the right as depicted in FIG. 6. Rod 140 is provided with threading 158 at its right end which is adapted to screw into a corresponding threaded bore hole (not shown) in member 132 of universal joint 42. As will be described in greater detail below, the resilient bias of rod 140 is used in a clutching mechanism at the opposing end of extension 24 to facilitate the overall operation of the device.

Turn now to FIG. 7 which shows an end view of the extension tube 40 seen through lines 7—7 of FIG. 6. In FIG. 7 a clear elevational end view of lock washer 148 is shown. Rod 140 is seen extending through lock washer 148 and as including a hexagonal hollow bore 160 concentrically defined in the left end of rod 140. As will be described in detail in connection with FIG. 8, a hexagonal drive rod is disposed in hexagonal bore 160 and it serves impart the rotary motion thereto.

Figure 8:
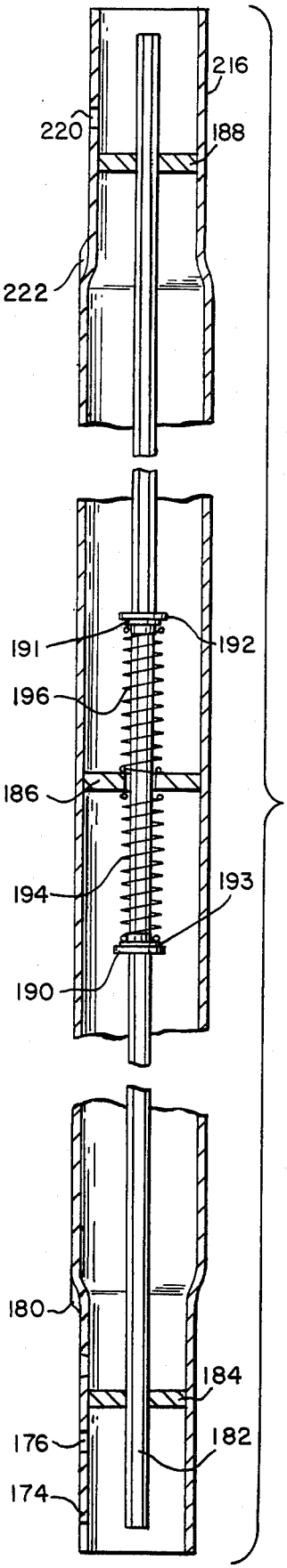
FIG. 8 is a fragmentary cross-sectional view in enlarged scale of the cross-sectional tube extending between the tube attachment of FIG. 6 and the motor.

Turning again to FIG. 1, extension tube 40 is shown as coupled to a mid-extension tube 38 which is better illustrated in an cross-sectional fragmentary view in enlarged scale in FIG. 8. Extension tube 40 couples to mid-extension tube 38 by means of a resilient locking pin best shown in the left end of the extension tube 40 in FIG. 6. The locking mechanism is shown in cutaway view and includes a locking pin 162 mounted on the end of a resilient leaf 164 attached to the outside of extension tube 40. Locking pin 162 is slidingly disposed through a corresponding bore 166 defined in tube 40. Leaf 164 in turn is enclosed within a housing 168 attached to the outside of tube 40 which is diagrammatically depicted in FIG. 1. Housing 168 is arranged and configured according to means well known in the art to accept a sliding plate 170. Plate 170 includes a cam 172 on its lower portion which is brought to bear against the rear surface of leaf 164. In the illustration of FIG. 6, slide 170 is shown in its leftmost position with locking pin 162 withdrawn from the interior of tube 40. However, when slide 170 is moved to the right in FIG. 6, cam 172 will bear against the rear surface of leaf 172 thereby forcing pin 172 into the interior space within tube 40.

As can be appreciated by now comparing tube 40 in FIG. 6 with the upper portion of mid-extension tube 38, tube 40 will be disposed over end 174 to align pin 162 with a corresponding hole 176 defined in tube 38. Slide 170 is then activated and pin 162 is forced through hole 176 thereby locking tubes 38 and 40 together. The end of tube 40 further includes an annular reinforcing member 178 which serves to increase the strength and rigidity of the coupling joint between tubes 38 and 40. Inasmuch as hole 176 is completely covered by the end of tube 40, an alignment slot (not shown) is defined in the end of tube 40 to mate with a corresponding alignment tab 180 defined in the outer surface of tube 38. Therefore, tube 40 is disposed onto tube 38 with tab 180 being inserted into alignment slot (not shown). At this point, the user is then assured that locking pin 162 is aligned with hole 176 and thereafter the locking pin is disposed through hole 176 as described above securely locking the two pieces together.

Turn your attention now to mid-extension 38 of FIG. 8. Tube 38 is characterized by a solid hexagonal drive rod 182 extending through its length. In the preferred embodiment rod 182 is supported at three places within tube 38, namely near end 174 by means of a support member 184, near the center by means of a support member 186, and at its opposing end by means of a support member 188. Rod 182 is disposed through support members 184–188 and is rotatable within each support member. A circular hole is defined in each of the support member just sufficient to center and retain hexagonal rod 182 on center. As before, two compression lock washers 190 and 192 are fixed to rod 182 on each side of central support number 186. A compression spring 194 and 196 is then placed on each side of support member 186 and inside the corresponding lock washer 190, 192 respectively. Springs 194 and 196 are each disposed against respective adjacent washers 190 and 192 with the aid of a centering washer 191 and 193 respectively. Centering washers 191 and 193 have a flat circular base and a cylindrical axial projection which extends into the axial space defined by the cylindrical compression springs 194 and 196. Washers 191 and 193 thus serve to reduce or substantially eliminate the wear of washers 192 and 190 against springs 196 and 194 respectively. Therefore, rod 182, while being free to rotate within mid-extension tube 38 is resiliently centered within the tube but allowed to be longitudinally displaced therein. Again, the resilient longitudinal displacement of rod 182 is connected with a clutch mechanism which will now be described in greater detail in connection with FIGS. 9–12.

Figure 9:
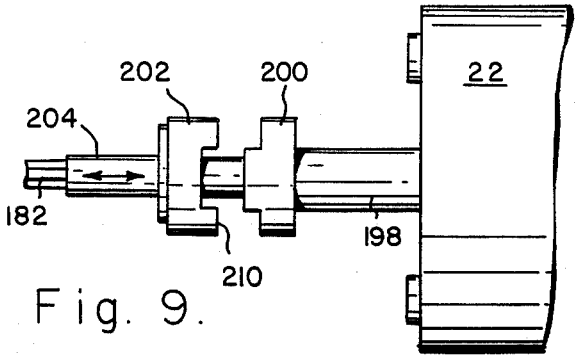
FIG. 9 is a partially cross-sectional and fragmentary view of the coupling assembly between the extension tube and the motor.

Turn first to FIG. 9 which shows a simplified elevational side view of the clutch mechanism with the surrounding structure removed for the sale of simplicity. A conventional electric motor 22 is provided with an output shaft 198 to which is rigidly connected to a first clutch member 200. A second clutch member 202 is rigidly connected to a drive output shaft 204. Output shaft 204 extends through second clutch member 202 and is telescopically and concentrically disposed within drive shaft 198 as best seen in cross-sectional view in FIG. 10. The left portion of shaft 204 shown in FIGS. 9 and 10 further includes a hexagonal bore 212 into which hexagonal rod 182 is disposed as illustrated. Shaft 204 is slidingly disposed within a corresponding blind bore 206 defined within shaft 198. Blind bore 206 further includes a compression spring 208, one end of which bears against a wear washer 209 similar to washers 191 and 193 described above, which washer 209 is disposed in the blind bottom of bore 206. The other end of spring 208 bears against the opposing end of shaft 204. Spring 208 thereby urges clutch parts 200 and 202 into disengagement as shown in the configuration of FIG. 9. Clutch parts 200 and 202 are shown in an engaged configuration in FIG. 10. Clutch parts 200 and 202 are simply circular elements having a plurality of mating teeth or cogs 210. When clutch parts 200 and 202 are brought into contact, they mesh and thereby temporarily rotationally engage each other. Thus, it can be readily appreciated by comparing the illustrations of FIGS. 9 and 10 that if shaft 204 is urged to the right in the Figures, ultimately clutch parts 200 and 202 will engage and rotary motion from motor 22 will be imparted to shaft 204. Otherwise in the unbiased configuration of the clutch mechanism of FIGS. 9 and 10, clutch parts 200 and 202 will remain in a disengaged configuration as shown in FIG. 9 by virtue of compression spring 208 depicted in FIG. 10.

Figure 11:
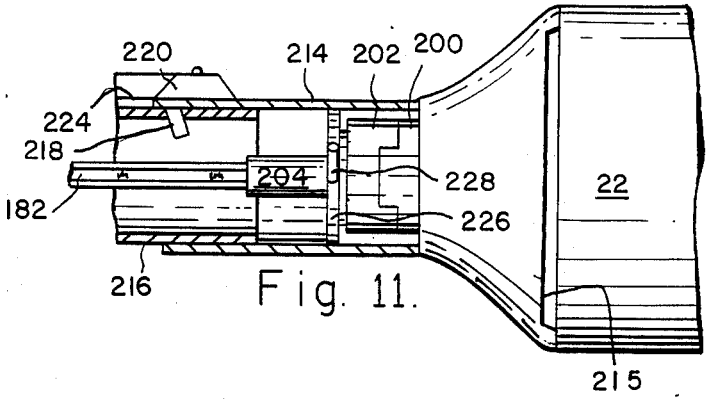
FIG. 11 is a side elevational view of the clutch mechanism employed in the assembly of FIG. 9, shown in a disengaged configuration and with the surrounding structure removed.
Figure 10:
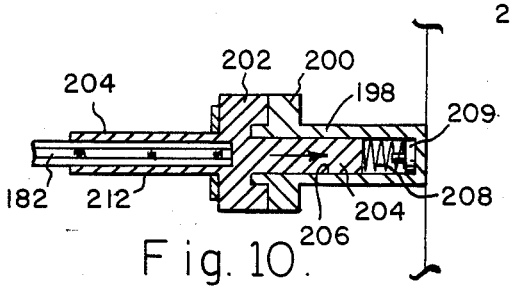
FIG. 10 is fragmentary elevational view of the assembly shown in FIG. 9.

Turn now to FIG. 11 which depicts additional structural elements combined with the clutch mechanism shown in isolation in FIGS. 9 and 10. Motor 22 is rigidly coupled to or integrally formed with a cylindrical housing 214 which has an internal diameter which slip-fits into the reduced diameter of end 216 of rod 38 of FIG. 8. Housing 214 has a plurality of apertures 235 defined therein to serve as ventilation slots for motor 22. As similarly described above, end 216 of rod 38 is locked to housing 214 by means of a locking pin 218 and slide mechanism 220. The locking mechanism is substantially the same as described in connection with the opposing end 174 of rod 38 in connection with locking pin 162 of tube 40. In other words, locking pin 218 is disposed through a hole 220 defined in end 216 which is aligned with pin 218 by means of an alignment tab 222 of tube 38 which is aligned and disposed into alignment slot 224 defined in tubular housing 214. Thus, rod 182 will ultimately be brought to rest and disposed into hexagonal bore 212 in shaft 204.

However, even when tube 38 is locked into position in housing 214 extending from motor 22 insufficient displacement of shaft 204 and clutch part 202 has occurred to bring clutch parts 200 and 202 into engagement. Motor 22 instead must be manually urged to the right as shown in FIG. 11 until the clutch parts engaged whereby the rotary motion is transmitted to rod 182 through extension tube 38, tube 40, universal joint 42 and ultimately to sanding plate 46. Therefore, while electric motor 22 may be constantly running, the rotary energy is imparted to sanding attachment 26 only when desired by pressing motor 22 toward sanding attachment 26. As depicted in FIG. 11, no longitudinal displacement respect to motor 22 and clutch part 200 and tubes 38 or 40 is possible since each of these elements are rigidly longitudinal locked together. However, by pressing sanding attachment 26 against the surface to be worked, universal joint 42 is pressed downwardly toward extension tubes 38 and 40. This causes drive shaft 140 and ultimately drive shaft 182 to be urged downwardly within tubes 40 and 38 respectively against the spring bias provided within these tubes so that clutch parts 200 and 202 approaches and ultimately engages clutch part 200 as depicted in FIG. 11. At this point, the rotary motion is imparted the shaft 182 and the sanding attachment begins to operate. Operation will continue as long as pressure is maintain between shaft 38 and 40 and sanding attachment 26. This pressure is applied in any event to press the sandpaper against the surface to be worked. Once this pressure is removed, the compression spring within tubes 38 and 40 as well as compression spring 208 within shaft 198 will cause the clutch parts 200 and 202 to disengage. Operation of sanding attachment 26 will then stop.

Figure 12:
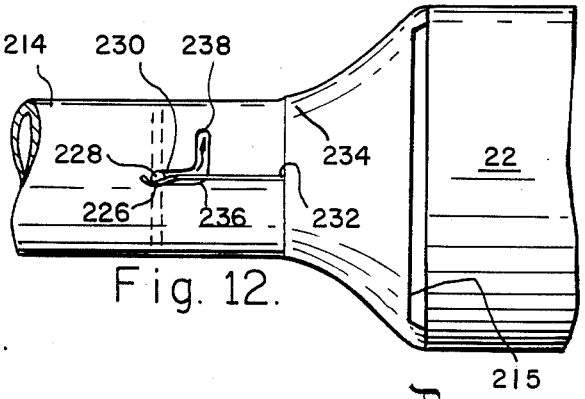
FIG. 12 is a simplified cross-sectional view of the clutch mechanism shown in FIG. 11, shown in an engaged configuration.

However, if it is desired that the sanding attachment continue to operate even without the relative pressure applied by the remainder of the tool on sanding attachment 26, clutch parts 200 and 202 can be maintained in engagement by means of a retaining plate 226 shown in elevational view in FIG. 11. Plate 226 is simply a circular plate having two extending ears or pins 228. One of such pins 228 is shown in FIGS. 11 and 12 while the opposing pin diametrically opposed in an identically situated on the opposing side of housing 214. Turn now to FIG. 12 which better depicts the operation of retaining plate 226. Pin 228, which forms an internal part of plate 226 shown in the dotted outline in FIG. 12, is extended through a curved slot 230 defined in housing 214. When in the position as shown in FIG. 12, plate 226 is retracted and does not bear against clutch part 202. Shaft 204 extends through a hole (not shown) in plate 226, therefore plate 226 forms a backing or pressure plate which can be slidingly be brought to bear against the back of clutch part 202. Normally, plate 226 is retained in the unengaged or extended position as shown in FIG. 12 by means of resilient retention pins 232 extending from base tube 234 of housing 214 and resiliently capturing pin 228 extending out of housing 214. When it is desired to force clutch parts 200 and 202 into engagement, the user manually grasps opposing pins 228 extending from the outside of each side of housing 214 and pulls plate 226 toward motor 22. This draws plate 226 down shaft 204 as depicted in FIG. 11, ultimately forcing clutch part 202 against clutch part 200 against the force of compression spring 208 pin (FIG. 10). When sufficient compression and engagement has been achieved, pins 228 will be positioned at a crook 236 of slot 230. Plate 226 is then rotated by disposing pins 228 into the radial portion 238 of slot 230, whereupon clutch parts 200 and 202 are retained in driving engagement regardless of the force brought to bear between the tool and sanding attachment 26.

It must be understood that the illustrated embodiment is shown only by way of example and is not intended to limit or restrict the scope of the invention. For example, in the illustrated embodiment base plate 44 and sanding plate 46 had been shown as solid metallic plates. However, it is entirely within the scope of the invention that substantial portions of both these plates will be removed to lighten sanding attachment 26. Such cut-out portions have been omitted from the illustrations in order to simplify the diagrammatic depictions. Therefore it must be understood that many modifications and alterations may be made by those having ordinary skill in the art without departing from the scope and spirit of the invention as defined in the following claims.

I claim:

1. A sanding tool comprising:

a lightweight sanding attachment;

a lightweight extension drive tube coupled to said sanding attachment; and a motor coupled to said extension drive tube, said motor characterized by comprising a substantial portion of the weight of said tool and for providing motive force to said sanding attachment through said extension drive tube, wherein said sanding attachment is a reciprocating sander, further comprising a universal joint, said universal joint coupling said extension drive tube and said sanding attachment, wherein said universal joint is further comprised of a first and second member, said first member coupled to said extension drive tube and said second member coupled to said sanding attachment, said first and second member coupled to each other and rotatable with respect to each other, said first and second member further characterized by a plurality of mating surfaces wherein a predetermined extreme angular orientation of said first member with respect to said second member, said first and second member come into contact and said surfaces of said first and second member form a smooth bearing surface with respect to each other, and wherein said predetermined extreme angular orientations of said first member relative to second member said angular orientation is permitted without interfering with the smooth relative rotation of said first member relative to said second member whereby a sanding tool is provided for use at positions spaced from said motor by at least a distance equal to the length of said extension drive tube and wherein a substantial portion of the weight of said sanding tool is concentrated in said motor assembly.

2. The tool of claim 1 wherein said sanding attachment comprises a sanding plate and a basal plate, said sanding plate being reciprocatingly driven with respect to said basal plate, said sanding plate characterized by an effective sanding surface, said effective sanding surface of said sanding plate being reciprocatingly disposed during reciprocation to be congruent at least at one point in time with the projection of said basal plate upon said sanding plate.

3. The tool of claim 1, wherein said extension drive tube comprises a resiliently biased rotatable drive rod disposed therethrough and a resiliently biased clutch coupled between said rod and said motor assembly, said resiliently biased clutch being resiliently biased in a disengaged configuration, said drive rod being urged against the resilient bias to cause said clutch to assume an engaged configuration, said drive rod being urged against said resilient bias by pressure being manually applied between said sanding attachment on the one hand and said extension drive tube and motor assembly on the other.

4. A sanding tool comprising:

a lightweight sanding attachment;

a lightweight extension drive tube coupled to said sanding attachment; and a motor coupled to said extension drive tube, said motor characterized by comprising a substantial portion of the weight of said tool and for providing motive force to said sanding attachment through said exension drive tube, wherein said sanding attachment is a reciprocating sander, wherein said sanding attachment comprises a sanding plate and a basal plate, said sanding plate being reciprocatingly driven with respect to said basal plate, said sanding plate characterized by an effective sanding surface, said effective sanding surface of said sanding plate being reciprocatingly disposed during reciprocation to be congruent at least at one point in time with the projection of said basal plate upon said sanding plate, whereby dead areas are substantially eliminated and whereby a sanding tool is provided for use at positions spaced from said motor by at least a distance equal to the length of said extension drive tube and wherein a substantial portion of the weight of said sanding tool is concentrated in said motor assembly.

5. The tool of claim 4, wherein said extension drive tube comprises a resiliently biased rotatable drive rod disposed therethrough and a resiliently biased clutch coupled between said rod and said motor assembly, said resiliently biased clutch being resiliently biased in a disengaged configuration, said drive rod being urged against the resilient bias to cause said clutch to assume an engaged configuration, said drive rod being urged against said resilient bias by pressure being manually applied between said sanding attachment on the one hand and said extension drive tube and motor assembly on the other.

6. A sanding tool comprising:

a lightweight sanding attachment;

a lightweight extension drive tube coupled to said sanding attachment; and a motor assembly coupled to said extension drive tube, said motor characterized by comprising a substantial portion of the weight of said tool and for providing motive force to said sanding attachment through said extension drive tube, wherein said extension drive tube comprises a resiliently biased rotatable drive rod disposed therethrough and a resiliently biased clutch coupled between said rod and said motor assembly, said resiliently biased clutch being resiliently biased in a disengaged configuration, said drive rod being urged against the resilient bias to cause said clutch to assume an engaged configuration, said drive rod being urged against said resilient bias by pressure being manually applied between said sanding attachment on the one hand and said extension drive tube and motor assembly on the other whereby a sanding tool is provided for use at positions spaced from said motor by at least a distance equal to the length of said extension drive tube resilient bias by pressure being manually applied between said sanding attachment on the one hand and said extension drive tube and motor assembly on the other.

7. A reciprocating sanding tool comprising:

a motor assembly for providing a motive force;

an extension drive tube rigidly coupled to said motor assembly;

an extension drive rod resiliently disposed within said drive tube, said drive rod resiliently urged to assume a preferred longitudinal position while being freely rotatable within said drive tube;

a clutch assembly coupled between said motor assembly and extension drive rod, said clutch resiliently urged into a disengaged configuration;

a universal joint coupled to said drive rod, said universal joint characterized by exterior smooth mating bearing surfaces to permit free sliding contact between the opposing surfaces of said universal joint during operation even when said universal joint is configured into extreme angular configurations;

a basal plate coupled to said universal joint;

a sanding plate coupled to said basal plate, coupling of said sanding plate and basal plate permitting relative reciprocating motion between said sanding plate and basal plate, reciprocation of said sanding plate disposing said sanding plate in space to the same extent as said basal plate extends in space; and means for converting rotary motion of said universal joint into relative reciprocating motion between said basal plate and sanding plate.

8. The tool of claim 7, wherein said extension drive tube, extension drive rod, universal joint, basal plate, sanding plate and means for converting are each lightweight elements, the substantial portion of weight of said tool being confined to said motor assembly.

9. The tool of claim 7, wherein said extension drive rod is resiliently disposed within said extension drive tube and coupled to said clutch assembly so that the relative force between said sanding plate and said motor assembly coupled through said extension drive tube, universal joint and basal plate causes said clutch assembly to assume an engaged configuration, whereby said motive force is then transmitted from said motor assembly to said sanding plate.

10. The tool of claim 7, further comprising retainer clips disposed at the opposing ends of said sanding plate and gripping bars disposed in said sanding plate opposing each retainer clip, one gripping bar opposing each retainer clip at the set of opposing ends of said sanding plate, said retainer clip being extensible to allow disposition of a sandpaper strip between said retainer clip and gripping bar, said retainer clip being closable against said gripping bar to seize said sandpaper therebetween and lockable in said closed configuration.

11. The tool of claim 10, wherein said retainer clip comprises a pair of resiliently biased locking pins and a housing in which said locking pins are slidingly and telescopically disposed, said locking pins being resiliently urged into a locked configuration within said housing wherein said clip is mechanically temporarily fixed with respect to said sanding plate, said locking pins being selectively disposable within said housing leaving said retainer clip displaced with respect to said sanding plate.

* * * * *